US005806774A

United States Patent [19]

Vis

[11] Patent Number: 5,806,774

[45] Date of Patent: Sep. 15, 1998

[54] ANVIL FOR CENTRIFUGAL IMPACT CRUSHER AND CIRCLE OF ANVILS EQUIPPED WITH SUCH ANVILS

[75] Inventor: Jean Vis, Theux, Belgium

[73] Assignee: Magotteaux International, Vaux-Sous-Chevremont, Belgium

[21] Appl. No.: 803,191

[22] Filed: Feb. 19, 1997

[30] Foreign Application Priority Data

Feb. 27, 1996 [BE] Belgium ..... 09600168

[51] Int. Cl.[6] ..... B02C 19/00

[52] U.S. Cl. ..... 241/275; 241/293

[58] Field of Search ..... 241/275, 293

[56] References Cited

U.S. PATENT DOCUMENTS

| | | | |
|---|---|---|---|
| 3,088,685 | 5/1963 | Bridgewater . | |
| 3,093,329 | 6/1963 | Bridgewater | 241/275 |
| 3,474,974 | 10/1969 | Wood | 241/275 |
| 4,090,673 | 5/1978 | Ackers et al. | 241/275 |
| 4,756,484 | 7/1988 | Bechler et al. | 241/275 |
| 4,768,724 | 9/1988 | Ehmann et al. | 241/275 |
| 5,029,761 | 7/1991 | Bechler | 241/275 |
| 5,184,784 | 2/1993 | Rose et al. . | |

FOREIGN PATENT DOCUMENTS 2 131 722 A 11/1983 United Kingdom .

*Primary Examiner*—Mark Rosenbaum
*Attorney, Agent, or Firm*—Schmeiser, Olsen & Watts

[57] ABSTRACT

The anvil (10) overall has the shape of a prism with one curved lateral surface (16) and two lateral surfaces (18) (20) which have flanks (26) (28) adjacent to the curved surface (16) and directed along the axis of curvature of this surface (16). These flanks (26) (28) are moreover inclined with respect to a mid-plane of the anvil (10) passing through the axis of curvature of the surface (16). These anvils (10) are arranged alternately in one direction then the other in an anvil ring where they are held by an arch keystone effect to form a circle of anvils.

12 Claims, 3 Drawing Sheets

ANVIL FOR CENTRIFUGAL IMPACT CRUSHER AND CIRCLE OF ANVILS EQUIPPED WITH SUCH ANVILS

The present invention relates to an anvil for centrifugal impact crusher which overall has the shape of a prism comprising two bases and lateral surfaces, of which one lateral surface is a cylindrical surface with a given radius of curvature and of which two other lateral surfaces have flanks respectively adjacent to the cylindrical surface, these flanks being directed towards the axis of the said cylindrical surface. The invention also relates to a circle of anvils for centrifugal impact crusher comprising a cylindrical anvil ring with an interior and lower radial flange for vertically supporting a covering of anvils of the aforementioned kind, which are wedged inside the anvil ring by an arch keystone effect.

A crusher with a circle of anvils of this kind is described in the document U.S. Pat. No. 5,184,784. In this crusher, the anvils are placed freely inside the anvil ring and are held therein by an arch keystone effect without any specific fastening means. By contrast with other known systems which provide fastening means which suffer the intense impacts and are therefore subject to rapid wearing, having the anvils held by an arch keystone effect allows better distribution of the impacts and stresses on the anvil ring and gives the assembly greater longevity. Furthermore, in the absence of any internal fastening means, the anvils can be worn right down to the ring plate.

This system of mounting the anvils does, however, have the drawback that new anvils are difficult to fit, because when aligning the anvils individually one after another it is often difficult to insert the last anvil in the remaining space. Still more difficult is the replacement of worn anvils owing to the fact that they are fouled with ground material.

Furthermore, it is not possible to replace individual anvils in the crusher without disassembling the circle of anvils because, in the absence of any fastening means, disengaging one anvil would cause the other anvils to collapse in.

The object of the present invention is to provide a novel anvil as well as a circle of anvils equipped with such anvils which are also fastened by an arch keystone effect but which make it possible to make it easier to fit and to replace anvils individually.

In order to achieve this objective, the present invention provides an anvil of the kind described in the preamble which is essentially characterized in that the two flanks adjacent to the cylindrical surface are inclined with respect to a mid-plane of the anvil passing through the axis of curvature of the cylindrical surface, the inclinations of the two flanks being identical and in opposite directions.

The inclination of these flanks is preferably of the order of 3°–15°.

One of the bases of the anvil, preferably the one towards which the said flanks diverge, has two projecting tenons.

The invention also provides a circle of anvils equipped with an even number of anvils which are directed, vertically, in one direction then the other alternately.

The interior flange of the anvil ring has openings which serve as housings for the tenons of the anvils which are directed with the tenons downwards.

Fitting the new anvils consists merely first of all in placing half of the anvils with the tenons directed downwards and anchoring these in the openings provided for this purpose in the flange of the anvil ring and then in sliding into the spaces remaining between these fitted anvils the ones which are directed with the tenons upwards or those which have no tenons. Fitting the latter anvils is made easier by the inclination of the lateral flanks which automatically guide the anvils onto their seat.

Other specific features and characteristics will become clear from an advantageous embodiment given hereinbelow by way of illustration with reference to the attached figures in which:

FIG. 1 diagrammatically represents a plan view of a first embodiment of a circle of anvils according to the present invention;

FIG. 2 diagrammatically represents a perspective view of an anvil ring;

Figure 8:
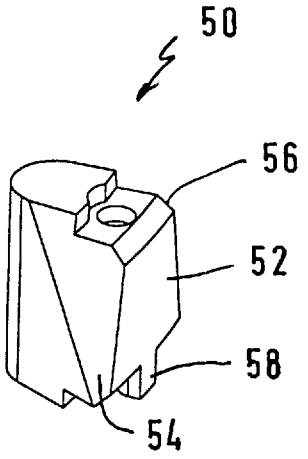
Figure 7:
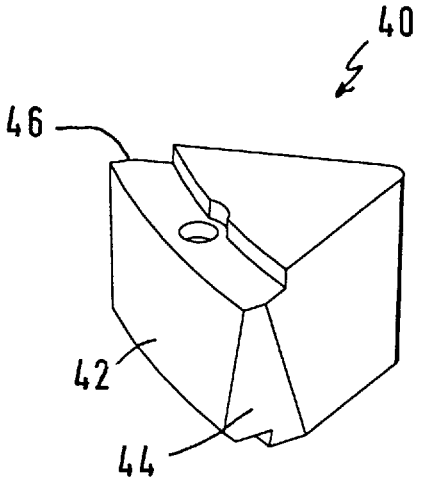
Figure 9:
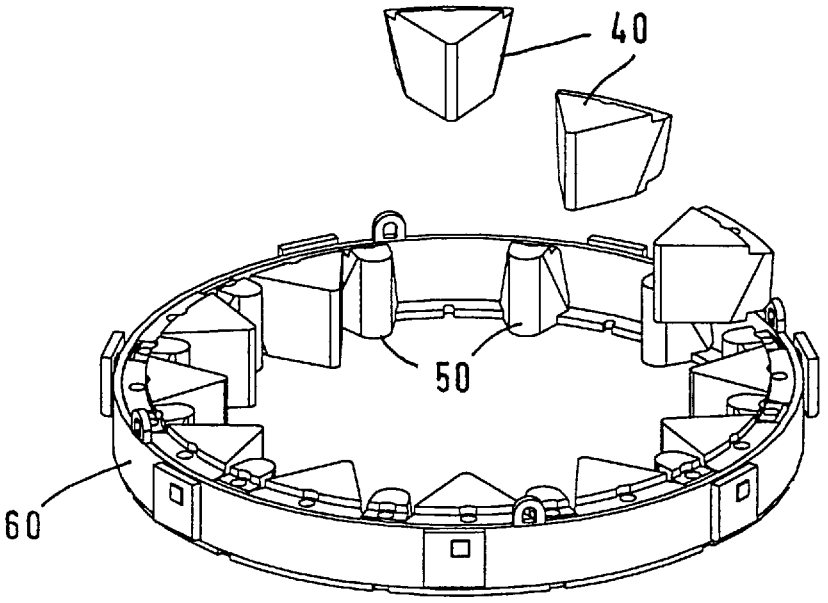

FIGS. 7 and 8 diagrammatically represent perspective views of two types of anvil of a second embodiment; and FIG. 9 represents a perspective view diagrammatically illustrating the fitting of the anvils of the second embodiment.

Figure 1:
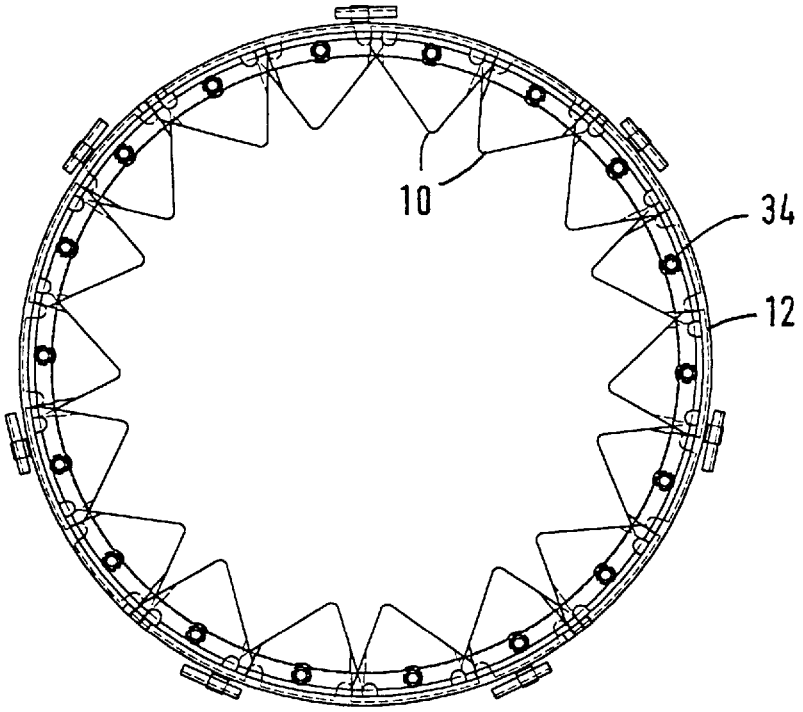
Figure 2:
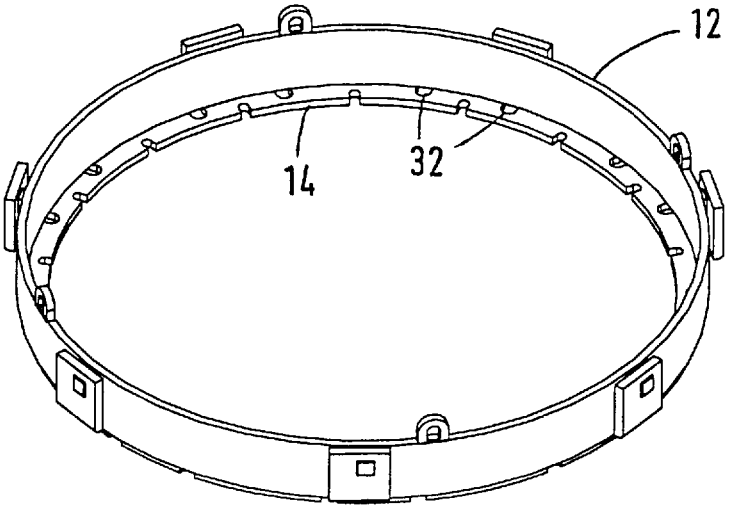

FIG. 1 shows a circle of anvils similar to the one described in the document U.S. Pat. No. 5,184,784 but equipped, in the example represented, with 18 individual anvils 10 according to the present invention. These anvils cover the interior surface of a circular anvil ring 12 represented in FIG. 2. This ring 12 includes, at its base, an interior radial flange 14 intended to support the covering of anvils 10.

Figure 3:
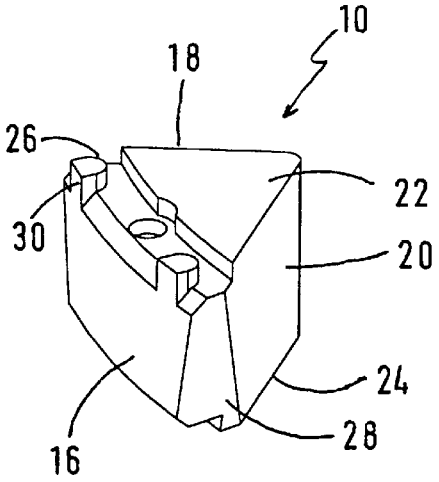
FIG. 3 represents a perspective view of a first embodiment of an anvil with the tenons pointing upwards.
Figure 4:
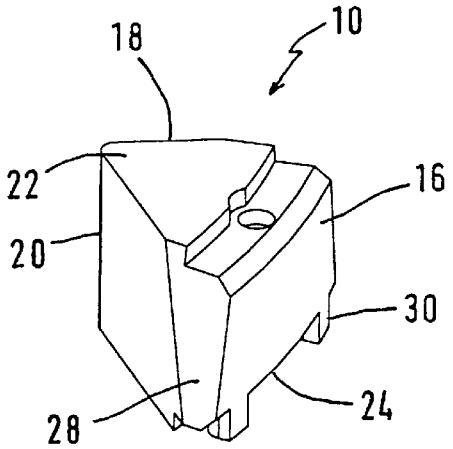
FIG. 4 represents the anvil in perspective with the tenons pointing downwards.
Figure 5:
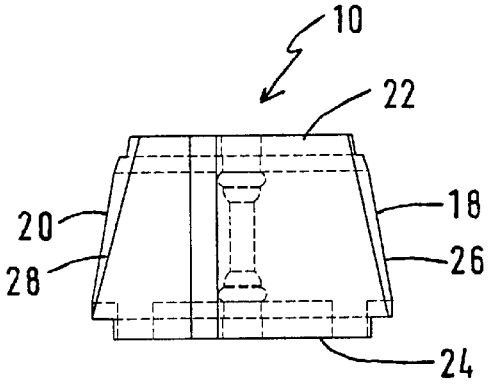
FIG. 5 represents an elevation view of the anvil.

An anvil 10 according to the present invention is represented in FIGS. 3 to 5. Such an anvil 10, cast in an alloy which has good impact strength, overall has the shape of a prism, preferably with single triangular section with a rear cylindrical face 16 intended to match the curvature of the ring 12, two lateral faces 18 and 20 and two bases 22 and 24.

According to the essential characteristic of the present invention, the two lateral surfaces 18 and 20 include, where they meet the rear cylindrical surface 16, two flanks 26 and 28 which form undercuts with an inclination which can vary between 3° and 15° with respect to the vertical, thus giving the anvil 10 a slightly frustoconical shape as FIG. 5 shows. The lateral surfaces 18, 20 themselves may be vertical or also slightly inclined like their flanks 26 and 28. The plane of the flanks 26 and 28 is furthermore overall perpendicular to the cylindrical face 16, that is to say directed towards the axis of curvature of this surface 16 so as to ensure that the anvils 10 are held in place by an arch keystone effect like in the aforementioned patent.

The widest base of the anvil, that is to say the one towards which the flanks 26 and 28 diverge, has two tenons 30, while the flange 14 of the anvil ring has openings 32 forming housings for these tenons 30.

Figure 6:
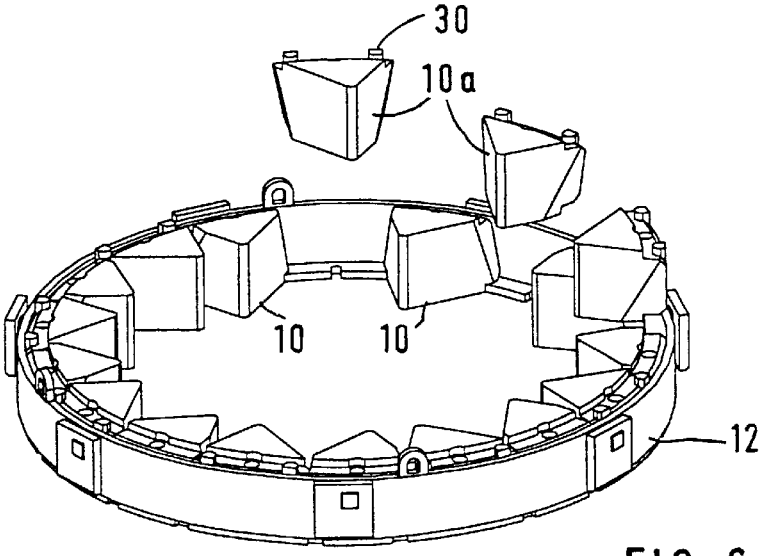
FIG. 6 represents a perspective view diagrammatically illustrating the fitting of the anvils.

FIG. 6 diagrammatically illustrates the fitting of the anvils into the anvil ring 12 in order to form the circle of anvils represented in FIG. 1. First of all, nine anvils 10 are positioned, with the tenons 30 directed downwards, ensuring that these tenons 30 are engaged in the corresponding openings 32 in the flange 14 of the ring 12. The nine remaining anvils 10*a* are then slid, with the tenons 30 directed upwards, into the spaces remaining between the previously fitted anvils 10. As a result of the undercuts of the lateral flanks 26 and 28, the anvils 10*a* and their housings between the anvils 10 already fitted have complementing tapers, so that it is extremely easy to fit the anvils given that they are automatically guided into place. Once all the anvils 10 and 10*a* have thus been positioned, they are held in place radially by an arch keystone effect, given that their flanks 26 and 28, apart from their undercuts, converge in the direction of the axis of the ring 12.

It is as easy to replace individual anvils as it is to fit them. The anvils 10*a* directed with the tenons 30 upwards may be lifted individually out of their housings, the other anvils 10 and 10*a* remaining in place since they are wedged in radially by an arch keystone effect and cannot move laterally because of the anvils which are wedged by their tenons 30 in the housings 32 of the ring 12. This makes it possible to replace individual anvils in the crusher without having to disassemble the circle of anvils.

The anvils 10 which are anchored by their tenons 30 in the flange 14 may also be dismantled individually but, because of the undercuts of the flanks 26 and 28, the two neighbouring anvils 10*a* have first of all to be disengaged.

To make the handling of the anvils, especially fitting and removal with a suitable tool, easier, each anvil may be equipped with an appropriate purchase symbolized, in the example represented, by a bore 34 passing vertically through each anvil.

The functions of the tenons in the anvils and of the housings may also be reversed insofar as the housings 32 of the ring 12 may be replaced by tenons and the tenons 30 of the anvils may be replaced by cavities for accommodating the tenons of the ring.

FIGS. 7 and 8 represent the two anvils of an embodiment which envisages two different types of anvil such as combined in the circle of anvils represented in FIG. 9. The anvils 40 of FIG. 7 are anvils proper and correspond to the anvils 10 of the preceding figures. These anvils 40 also have a cylindrical rear face 42 and two flanks 44 and 46 directed to the axis of curvature of the face 42 so as to be wedged by an arch keystone effect and inclined by 3° to 15° with respect to the vertical. However, by contrast with the anvils 10, the anvils 40 do not have tenons.

The anvils 50 of FIG. 8 are, in fact, mini-anvils which, although they also receive material to be crushed, act rather more like insert pieces used to wedge the anvils 40 proper. The anvils 50 also have a rear cylindrical face 52 and lateral flanks 54 and 56 directed to the axis of curvature of the rear face and an undercut with respect to the vertical identical to that of the anvils 40 but in opposite directions. The anvils 50 also each have a tenon 58 on the base towards which the flanks 54, 56 diverge, the lower base in FIG. 8.

The anvils 40 and 50 are fitted in the same way as in the preceding embodiment, knowing that each anvil 40 has to be surrounded by two anvils 50 and vice versa. The anvils 50 are first of all fitted, ensuring that their tenon 50 is anchored in the corresponding housings the ring. All that is then required is to slide the anvils 40 between the already placed anvils 50, the inclinations of their flanks 44 and 46 and those of the flanks 54 and 56 of the anvils 50 automatically guiding them into the correct position.

The embodiment of FIG. 9 is essentially intended to replace that of the preceding figures so as to reduce the number of anvils when the nature of the material to be crushed demands it.

I claim:

1. Anvil for centrifugal impact crusher which overall has the shape of a prism comprising two bases and lateral surfaces, of which one lateral surface is a cylindrical surface with a given radius of curvature and of which two other lateral surfaces have flanks respectively adjacent to the cylindrical surface, these flanks being directed towards the axis of curvature of the cylindrical surface, characterized in that the two flanks are inclined with respect to a mid-plane of the anvil passing through the axis of curvature of the cylindrical surface, the inclinations of the two flanks being identical and in opposite directions.

2. Anvil according to claim 1, characterized in that the inclinations of the flanks are of the order of 3°–15°.

3. Anvil according to claim 1, characterized in that one of the bases has two projecting tenons.

4. Anvil according to claim 3, characterized in that the tenons are situated on the base towards which the flanks diverge.

5. Anvil according to claim 1, characterized in that one of the bases has a projecting tenon.

6. Anvil according to claim 5, characterized in that the tenons are situated on the base towards which flanks diverge.

7. Circle of anvils for centrifugal impact crusher comprising a cylindrical anvil ring with an interior and lower radial flange for vertically supporting a covering of anvils which overall have the shape of a prism comprising two bases and lateral surfaces of which one lateral surface is a cylindrical surface with the same radius of curvature as the anvil ring and of which two other lateral surfaces have flanks respectively adjacent to the cylindrical surface and directed towards the center of the anvil ring, the anvils being wedged inside the anvil ring by an arch key-stone effect, characterized in that the flanks of the lateral surfaces are inclined with respect to a radial mid-plane of the anvil passing through the central axis of the anvil ring, the inclinations of the two flanks being identical and in opposite directions.

8. Circle of anvils according to claim 7, characterized in that all the anvils are identical and directed vertically, in one direction then the other alternately.

9. Circle of anvils according to claim 8, characterized in that the anvils have, on one of the bases, two tenons and in that the interior flange of the anvil ring has corresponding openings for accommodating the tenons.

10. Circle of anvils according to claim 7, characterized by two groups of anvils of different size, each anvil of one group being surrounded by two anvils of the other group and vice versa.

11. Circle of anvils according to claim 10, characterized in that the anvils of one of the groups have a tenon at one of their bases and in that the interior flange of the anvil ring has corresponding openings for accommodating the tenons.

12. Circle of anvils according to claim 7, characterized in that the inclinations of the flanks are of the order of 3°–15°.

* * * * *